United States Patent [19]

Ghisoni

[11] Patent Number: 4,899,478

[45] Date of Patent: Feb. 13, 1990

[54] DEBASED BARREL REVOLVER

[76] Inventor: Emilio Ghisoni, Via Villa Serafina, 4 - 27100 Pavia, Italy

[21] Appl. No.: 308,506

[22] Filed: Feb. 10, 1989

[30] Foreign Application Priority Data

Feb. 10, 1988 [IT] Italy ..... 19367 A/88

[51] Int. Cl.[4] ..... F41C 1/00; F41C 17/08

[52] U.S. Cl. ..... 42/65; 42/66

[58] Field of Search ..... 42/59, 65, 66

[56] References Cited

U.S. PATENT DOCUMENTS

| | | | |
|---|---|---|---|
| 3,027,673 | 4/1962 | Oliver | 42/65 |
| 4,041,633 | 8/1977 | Scrufari | 42/65 |
| 4,285,152 | 8/1981 | Dean | 42/59 |
| 4,651,456 | 3/1987 | Ghisoni | 42/59 |

*Primary Examiner*—Charles T. Jordan

*Assistant Examiner*—Michael J. Carone

*Attorney, Agent, or Firm*—Sughrue, Mion, Zinn, Macpeak & Seas

[57] ABSTRACT

A debased barrel revolver is disclosed which comprises a stock having a rear mount, a cylinder carried rotatably on said stock close against the rear mount, a barrel mounted on the stock in alignment relationship with a bottom cartridge chamber of the cylinder, and a release and percussion mechanism, and wherein at least some of the components of the release and percussion mechanism are supported in a chamber formed in the rear mount and extending therein perpendicularly to and above the barrel. By virtue of the reduced extent in the longitudinal direction of the release and percussion mechanism, substantially all of the elastic potential energy stored up therein can be utilized on striking.

16 Claims, 14 Drawing Sheets

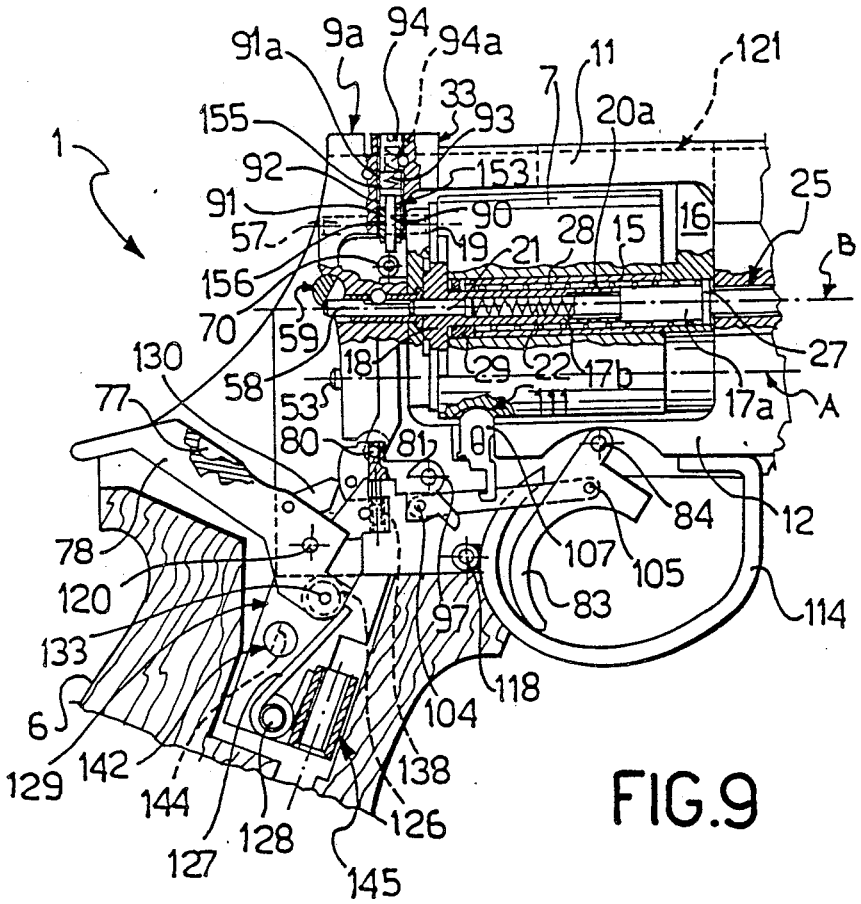
FIG.9
FIG.10
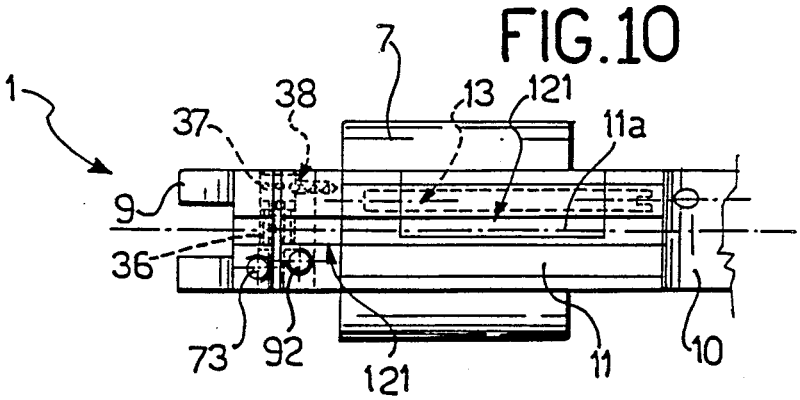

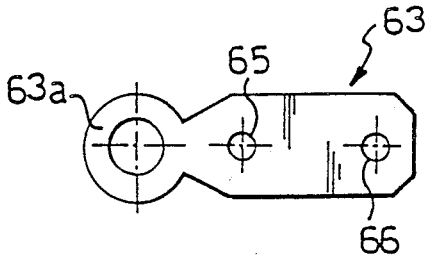
FIG.22
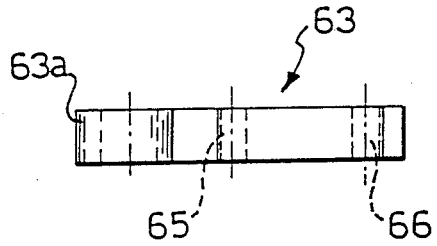
FIG.23
FIG.24
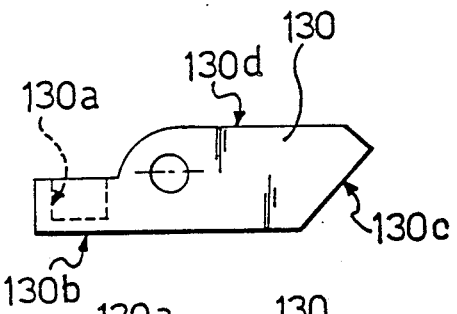
FIG.25
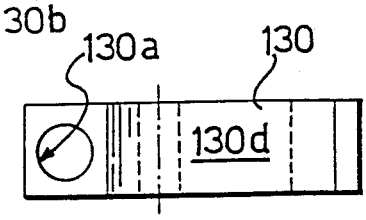

FIG.26
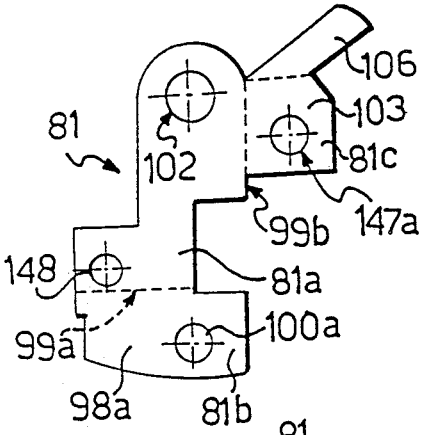
FIG.27
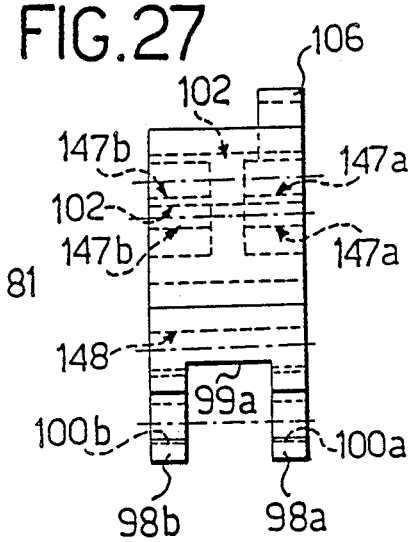
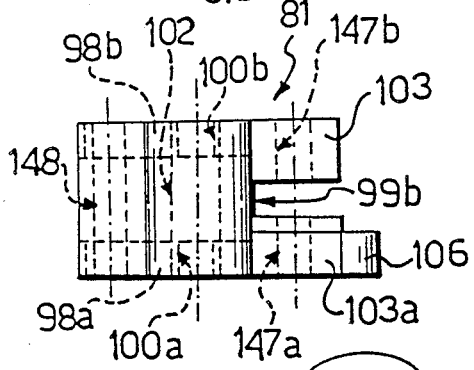
FIG.28
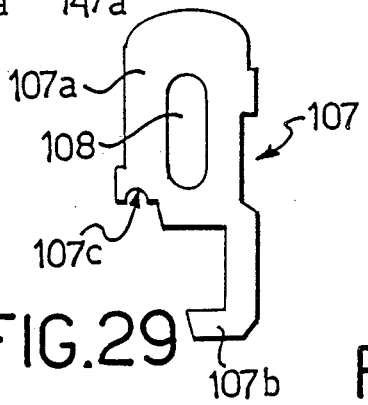
FIG.29
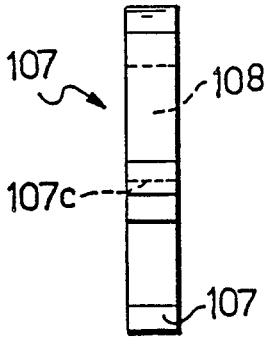
FIG.30

DEBASED BARREL REVOLVER

BACKGROUND OF THE INVENTION

This invention relates to a debased barrel revolver of a type which comprises a stock having a rear mount, a cylinder carried rotatably on said stock at a location close against said rear mount, a barrel mounted on said stock aligned to a bottom cartridge chamber of the cylinder, and a release and percussion mechanism.

It is a well-known fact that the recognized current popularity of the revolver pistol is mostly due to its simplicity and reliable operation.

Also known is, however, that revolvers to traditional designs still exhibit a persistent and yet unremedied proneness to pitching from the recoil force generated on firing.

In an attempt at attenuating this unfavorable proclivity to pitching, the pertinent art recently proposed the so-called upside-down revolvers fitted with a debased barrel, i.e a barrel set in line with the lowermost cartridge chamber of the cylinder. This in order to reduce the distance from the line of action of the recoil force (barrel axis) to the pistol grip.

In addition, the need has been strongly felt ever since for revolvers wherein the elastic potential energy stored up in the release and percussion mechanism prior to firing can be wholly transferred to the striker.

However, with debased barrel revolvers, the fact that the release and percussion mechanism mainly extends in the longitudinal direction makes it necessary to pivot the cock at a point so far away from the striker as to cause the impact on each other to occur with a substantial tangential component.

Thus, the cock energy cannot be fully utilized, and there takes place an appreciable drag action of the cock over the striker resulting in mutual wear thereof.

SUMMARY OF THE INVENTION

The technical problem underlying this invention is to provide a debased barrel revolver the construction whereof enables full utilization for striking of the elastic potential energy stored up in the release and percussion mechanism.

This problem is solved, according to the invention, by a debased barrel revolver as indicated being characterized in that at least some of the component parts of said release and percussion mechanism are supported within a chamber formed in the rear mount and extending therein in a perpendicular direction to and above said barrel.

This re-location of the release and percussion mechanism brings about the added benefit of improving the gun robustness and compactness, while keeping its ballistic characteristics substantially unaffected.

In accordance with another aspect of the invention, said release and percussion mechanism comprises a cylinder-rotating arm movable vertically within said chamber and having its bottom end journalled on a distributor operatively linked to a trigger and its top end engaged with the cylinder and connected mechanically, by a lever plate to a rod-like safety catch lying parallel to said arm and being movable vertically within said chamber against the bias of a first spring means carried on the rear mount, said top end of the arm being linked operatively to a two-stage release mechanism setting device.

BRIEF DESCRIPTION OF THE DRAWINGS

Further features and the a vantages of this invention will become apparent from the following detailed description of an embodiment of a debased barrel revolver according to the invention, to be read in conjunction with the accompanying illustrative and non-limitative, drawings, where:

FIGS. 8, 9 and 11 are respective longitudinal axial section views taken through the stock of the revolver shown in FIG. 1, containing the release and percussion mechanism;

FIG. 10 shows schematically a view from above of part of the stock of the revolver of FIG. 1;

FIGS. 16 to 32 show in schematic form a number of mechanical parts accommodated in the stock of the revolver of FIG. 1.

DETAILED DESCRIPTION OF THE INVENTION

Figure 1:
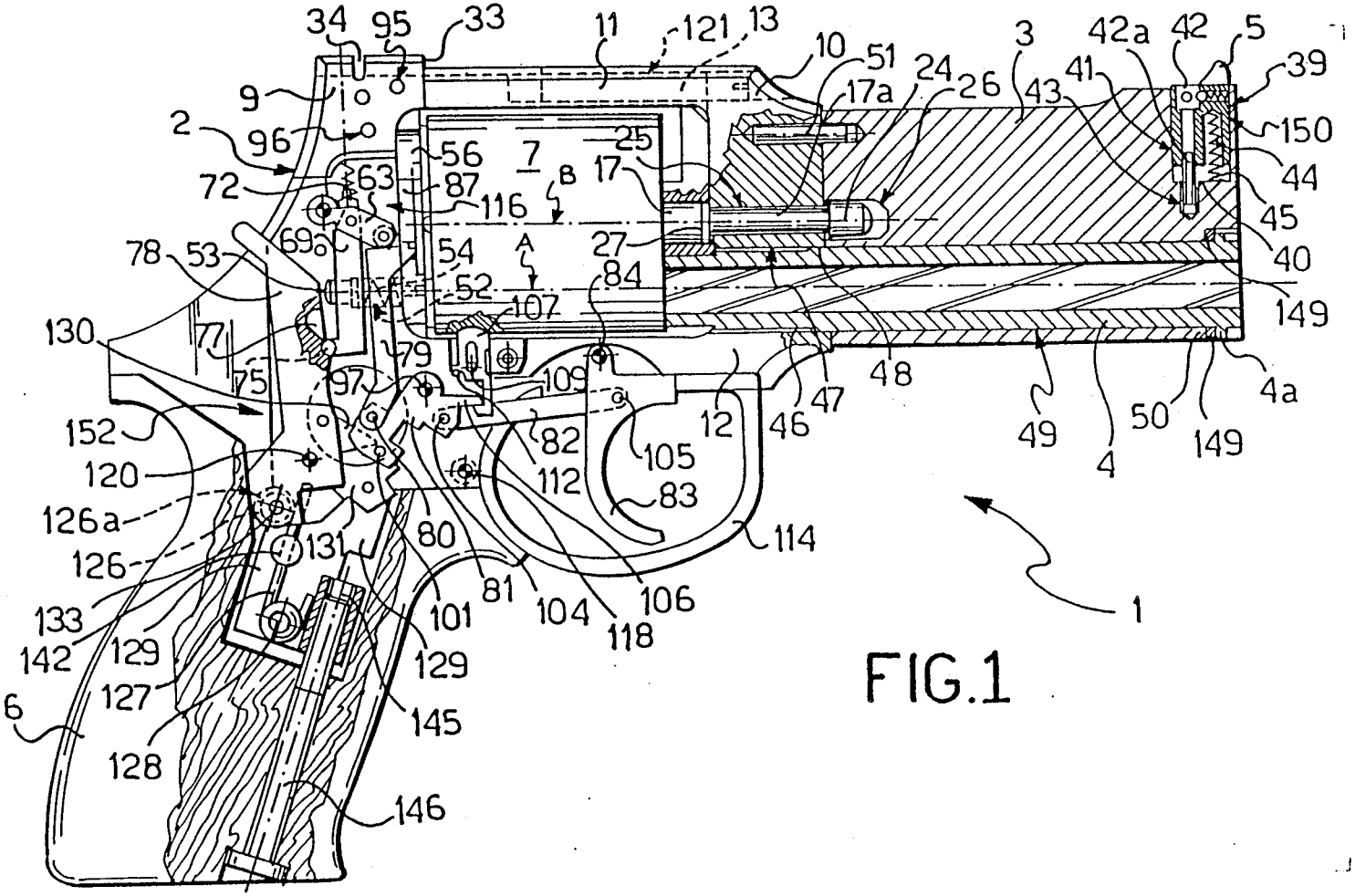
FIG. 1 is a longitudinal axial section view of a debased barrel revolver according to the invention.

With reference to the drawing views, the numeral 1 generally designates a revolver according to this invention.

This revolver includes a stock 2 carrying a release and percussion mechanism to be described and a barrel 4, a sleeve 3 provided with a sight 5, and a butt or grip 6.

The stock 2 is advantageously formed from plate steel by some elementary machining operations commonly referred to as "machining from the solid"; in this way, it can be imparted higher strength and compactness characteristics than prior revolvers.

A cylinder 7, including a number of cartridge chambers not shown, is connected to the stock 2 by a tilting member 8 of substantially yoke-like configuration which supports it in a pivotal fashion.

For a clearer understanding of the constructional and operational features of the inventive revolver, throughout the ensuing description the terms front and rear will refer to the gun as held in the hand, and the terms right and left should be understood as referred to the fore-and-after axis of the barrel 4 and/or the cylinder 7 and- /or the stock 2. The latter is comprised of a rear mount 9 and a front mount 10 which are held apart by a distance substantially equal to the length of the cylinder 7, and of a pair of upper and lower crosspieces indicated at 11 and 12, respectively.

Figure 2:
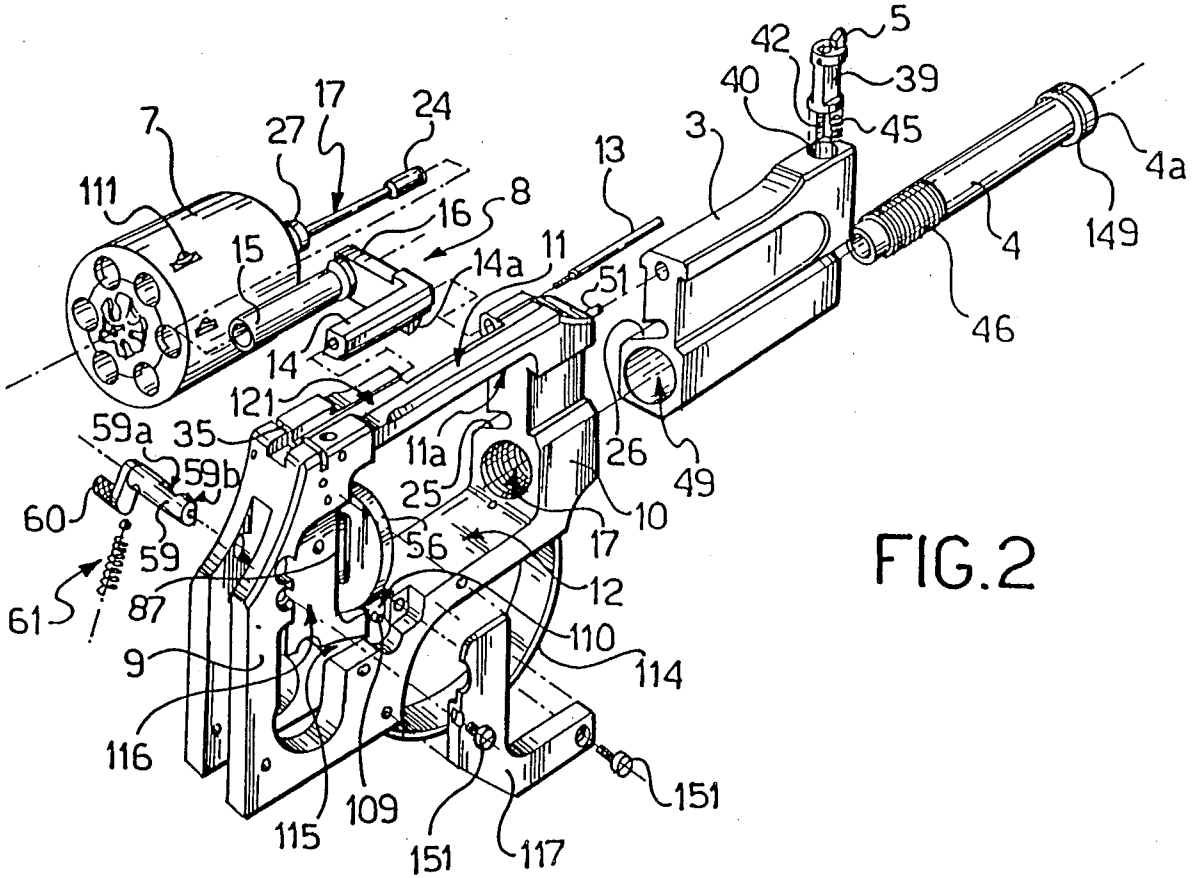
FIG. 2 is an exploded perspective detail view of the revolver shown in FIG. 1.

The tilting member 8 supporting the cylinder 7 is mounted detachably on the stock 2, to which it is journalled lengthwise around a pin 13 extending longitudinally through the upper crosspiece 11 (FIG. 2).

In particular, the tilting member 8 comprises a first arm 14 journalled around the pin 13 and a second arm 15 attached cantilever-fashion to a small plate 16 the other end whereof is attached to the first arm 14.

Said arm 14 forms, with the cylinder fully seated in the stock (firing position), a front portion 11*a* of the upper crosspiece 11 of the stock 2 (see FIG. 10).

The arm 15 (FIG. 2) extends unimpeded toward the rear mount 9 and is dimensioned to engage slidingly and pivotally within a bore 7*a* extending axially through the cylinder 7. The arm 15, moreover, is bored axially to freely admit an ejector rod 17 therethrough.

Figure 3:
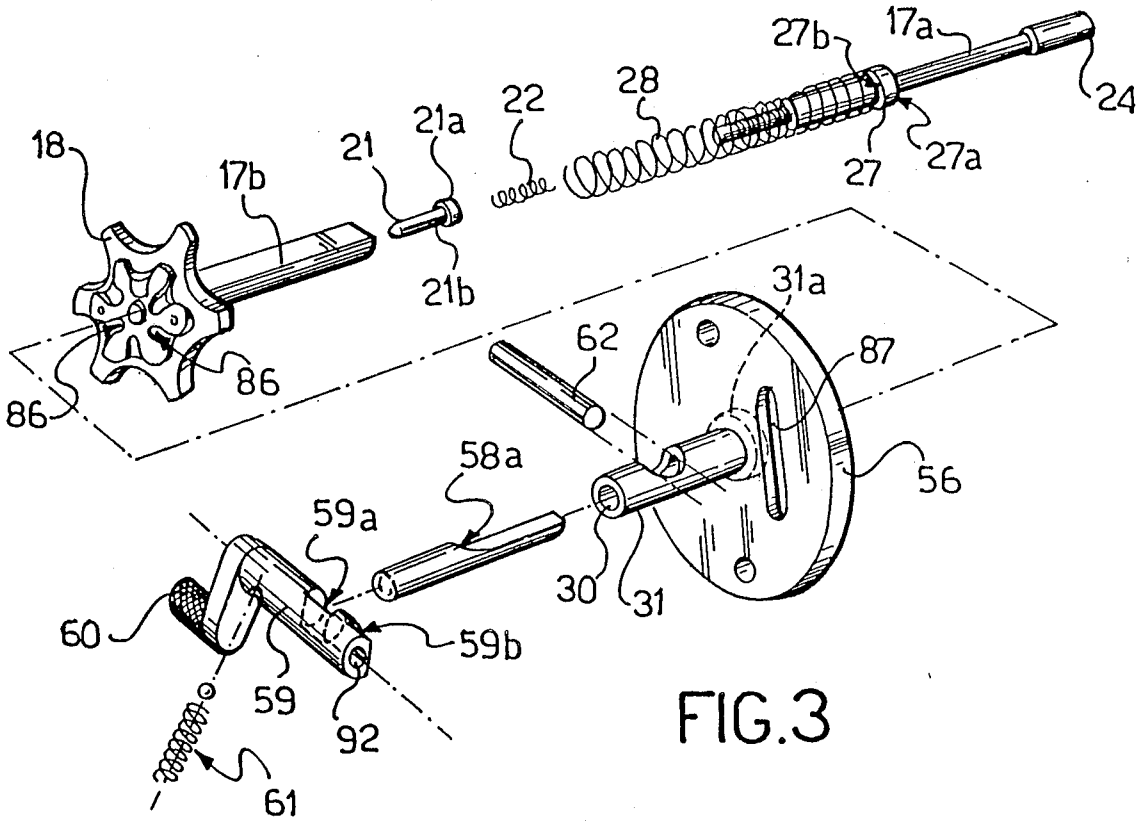
FIG. 3 is an enlarged scale, exploded perspective view of some details of the revolver shown in FIG. 1.
Figure 4:
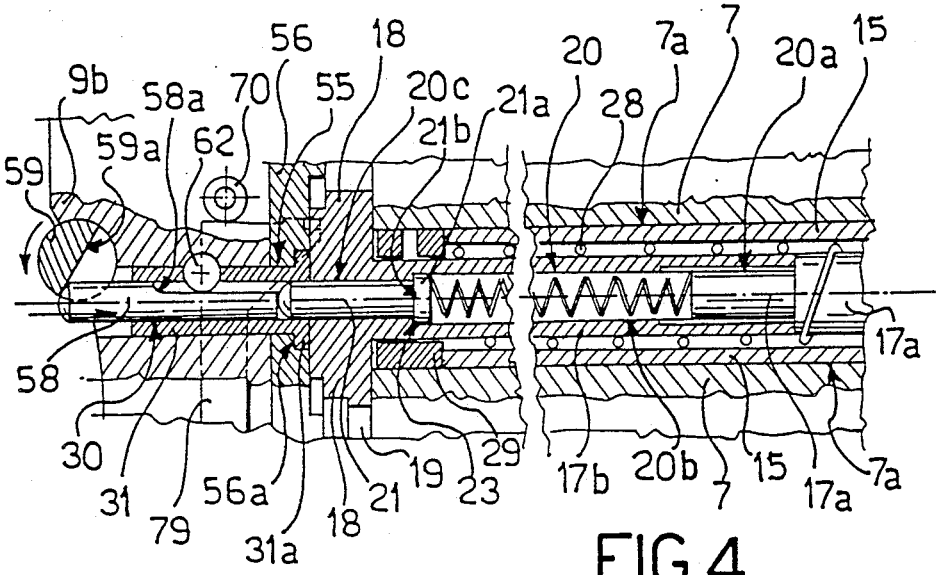
FIGS. 4 and 5 are enlarged scale, longitudinal axial section views showing some details of the debased barrel revolver according to the invention.
Figure 5:
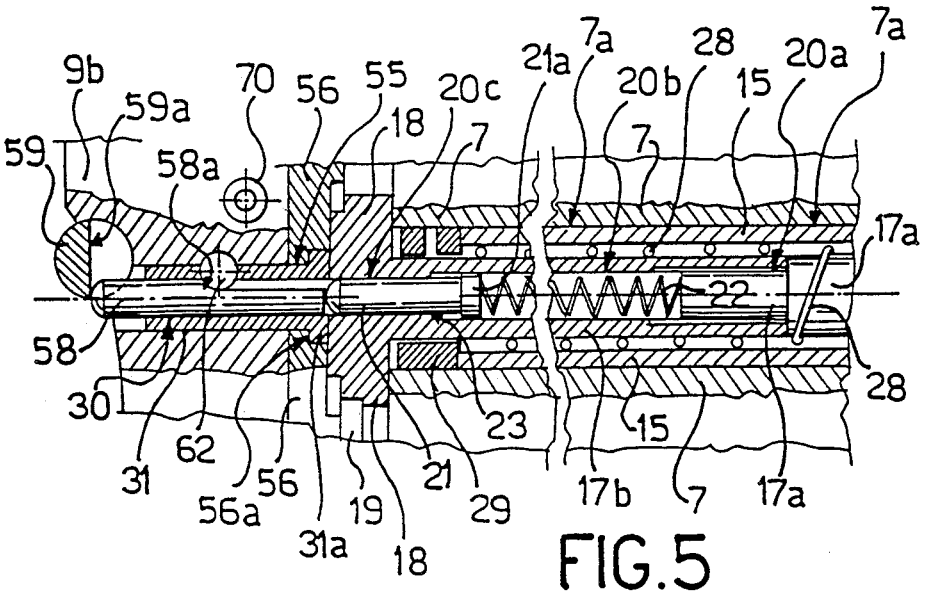

The rod 17 (FIG. 3) has a substantially cylindrical front portion 17*a* and a prismatic rear portion 17*b* from which an integrally formed, substantially disk-shaped spider ejector 18 extends to unload the cartridge chambers of the cylinder 7 of plural cartridges 19, of which an end (bottom) portion only is shown in FIGS. 4, 5 and 9.

The rear portion 17*b* of the rod 17, having a larger diameter than the front portion 17*a*, is formed with an axial bore 20 (FIGS. 4 and 5) including a threaded front section 20*a*, a smooth middle section 20*b*, and a rear section 20*c* having a smaller diameter than the other two sections. The portion 17*a* of the rod 17 has a rearwardly located threaded section of short length fitting threadably into the portion 20*a* of the bore 20. In this way, the bore 20 provides a seat for accommodating a pin 21 which is constantly biased leftwards (as shown in FIGS. 4 and 5) by a respective spring 22.

The pin 21 has a head portion 21*a* defining an annular detent 21*b* adapted to cooperate in abutment relationship with a corresponding annular shoulder 23 defined between the middle section 20*b* and the rear section 20*c* of the bore 20.

The front portion 17*a* of the rod 17 (see FIG. 1) is also provided with a mushroom-shaped head 24 integrally therewith. The front portion 17*a* and mushroom-shaped head 24 respectively fit into substantially semicircular grooves, indicated at 25 and 26, formed in the left-hand sides of the front mount 10 and the sleeve 3, respectively.

The front portion 17*a* of the rod 17 (FIG. 3) has a collar 27 located at the middle thereof which defines a pair of annular detents 27*a*, 27*b*, respectively front and rear ones. The rear detent 27*b* constitutes a rest base for a spring 28 housed within an annular portion which is defined between the inward wall of the arm 15 and the outward wall of the rod 17, which annular portion is closed at the rear by a bush 29 interfering with the bore 7*a* in the cylinder 7 (FIGS. 4 and 5).

The spring 28 constantly biases the ejector rod 17 against the thrust exerted thereon as the cartridges 19 are ejected from the cylinder 7.

By means of the tilting member 8, the cylinder 7 can be moved from a first position where it locates between the front 10 and rear 9 mounts of the stock 2 (firing position) to a second position where it locates fully away from said stock (cartridge loading/unloading position).

Said first position is defined by a positive stop formed between a flat wall 11*b*, provided at the bottom of the upper crosspiece 11 to span a front section thereof, and a flat wall 14*a*, provided at the top of the arm 14 on the tilting member 8 (see FIG. 2).

The cylinder 7, moreover, is releasably locked at the firing position by a so-called "snap-action" stop arrangement defined by the pin 21 engaging in a confronting bore 30 and formed in the rear mount 9. In particular, and as brought out by FIGS. 4 and 5, said bore 30 is an axial bore through a bush 31 fitting in the rear mount 9 and toward which the pin 21 is held biased by the spring 22.

With the cylinder 7 swung out on the upper crosspiece 11, the cylinder is prevented from slipping off the arm 15 by the provision of a shoulder 33 defined transversely of the stock 2 by an upper portion 9*a* of the rear mount 9.

A slot 34 (FIG. 1) accommodating a rear sight 35 is formed parallel with the shoulder 33 on this portion 9*a* of the rear mount. Thus, besides improving the gun construction strength, the added benefit is introduced of doing away with a protruding rear sight from the rear mount, to improve the gun compactness and handling convenience. It should be noted in this respect that, in order to permit collimation of the rear sight 35 to the sight 5, the rear mount 9 and upper crosspiece 11 are slotted longitudinally as at 121 (see FIGS. 2 and 10).

The rear sight 35 is provided downwardly with a bush 36 which is threaded internally and threadably engaged by a screw 37 (FIG. 10).

The line-of-sight direction adjustment is of the screw type: by manipulating the screw 37, in fact, the rear sight 35 can be correspondingly shifted in a desired direction.

That setting would be carried out "stepwise", as shown in FIG. 10, by means of a notch-and-ball detent arrangement 38 acting on the head of the screw 37.

The line of sight is adjusted for range by varying the setting of the sight 5 in the vertical direction.

For this purpose, the last-mentioned sight (FIG. 1) is arranged to extend integrally from a cylindrical piece 39 set in a corresponding matching seat 40 which is formed forwardly in the sleeve 3, substantially aligned to the muzzle of the barrel 4 and a throughgoing hole 41 intended to receive an adjustment screw 42.

Said adjustment screw 42 has a threaded end section 42*a* threadably engaged in a corresponding threaded blind hole 43 formed in the sleeve 3 at the bottom of the matching seat 40 and lying coaxially with the above-noted hole 41.

The cylindrical piece 39 is further formed at the bottom with a blind hole 44 which extends parallel to said hole 41 and provides a seat for receiving a spring 45 effective to constantly bias the cylindrical piece upwards (as viewed in FIG. 1).

Similarly to the rear sight 35, the sight 5 is also adjusted stepwise by means of a ball detent 150 acting on the head of the screw 42.

The front mount 10 (FIG. 1) is through-penetrated, at a location below the groove 25, by a threaded bore 47 which is preceded by a smooth start section 48 and has the same diameter as the barrel 4.

The sleeve 3 is also through-penetrated by a respective plain bore 49 lying coaxial with the former threaded bore 47.

At a front end of the bore 49, there is formed on the sleeve 3 an annular shoulder 50 adapted to cooperate with a collar 4*a* on the barrel 4 for the purpose of securing the sleeve 3 on the stock 2. That sleeve is properly located on the stock 2 by a set pin 51 preventing any relative rotation movement between the stock and the sleeve.

In order to achieve as true a mating as possible of the rear edge of the barrel 4 and the bottom cartridge chamber of the cylinder 7, a washer 149 intervenes between the collar 4*a* on the barrel 4 and the sleeve 3.

In this way, by appropriate selection of its thickness dimension, the washer 149 advantageously permits of variations, however slight, in the barrel length—as allowed by machining tolerances—to be accommodated. As is well recognized in the art, such tolerances may lead to the gases released on firing escaping into the outside environment and the gun range being reduced in consequence.

The barrel 4 is mounted on the revolver 1 by means of a threaded section 46 screw engaging in said bore 47 in the front mount 10.

With reference to FIG. 1, it should be noted that the axis A of the barrel 4 is coincident with the axis of the bottom cartridge chamber in the cylinder 7 with the latter held at the aforesaid first position (firing position). This axis A also coincides with the axis of a bore 52 formed in the rear mount 9 and providing a seat for a striker 53 and its related return spring 54.

Indicated at B is the axis of the cylinder 7 as held at the firing position. The axis B is coincident (FIGS. 4 and 5) with the axis of a bore 55 (coaxial with the bore 30 in the bush 31) which is formed centrally in a protective shield 56 removably attached to the rear mount 9 by means of the bush 31. For this purpose, the bush 31 is provided forwardly with a collar 31*a* arranged to abut against a matching annular seat 56*a* correspondingly formed at the shield center, and is in turn secured on the stock 2 by a cylindrical pin 62 which interferes therewith.

It should be further noted that the proper location is ensured for the shield 56 by a pin 57 preventing it from turning relatively to the rear mount 9 (FIG. 9).

Inside the bore 30 of the bush 31 (FIGS. 4 and 5), there fits slidably a cylindrical pusher 58 having a grooved profile shape for cooperation with the pin 21 to release the cylinder 7 from said first position within the stock 2 (firing position).

For the purpose, a small cylindrical shaft 59, accessible and manually operable from the outside of the rear mount 9, is arranged to act on the pusher 58 through a first camming profile 59*a* to push the pin 21 into the bore 20 against the bias force of the spring 22 (FIG. 3).

To allow the cylinder 7 to be unlocked, the shaft 59 can be rotated by means of a cranked end 60 outside the rear mount 9.

The shaft 59 is held locked, in a releasable manner, at either of two positions which are offset angularly from each other by a predetermined amount, by a detent ball locking device arranged to act on it at a location close to the cranked end 60 (see FIG. 3).

Such positions corresponds, as will become apparent herein below, to those taken by the shaft 59 before and after the release operation for releasing the cylinder 7 from the stock 2, respectively.

In order to limit the longitudinal travel of the pusher 58, the pin 62, which acts to secure the bush 31 on the stock 2, is made to cooperate with a shoulder 58*a* extending transversely across the grooved upper portion of the pusher (FIGS. 4 and 5).

The revolver 1 includes a release and percussion mechanism 152 carried on the stock 2 within a chamber 116 formed in the rear mount 9 and provided with an arm 79 for rotating the cylinder 7 which has a bottom end 79*b* pivoted to a distributor lever 81 operatively linked to a trigger 83 and cooperating with a cock 78, and a top end 79*a* mechanically connected to a rod-shaped safety catch 69 via a lever 63 supported pivotally within the chamber 116, and with a device 153 for setting a two-stage release.

With reference to FIG. 1, it should be noted that the chamber 116 extends in the rear mount 9 perpendicularly to and above the axis A of the barrel 4.

It follows that, in accordance with a peculiar feature of this invention, at least some of the components of the release and percussion mechanism (see FIG. 1) will be supported on the stock 2, as against the teachings of the prior art, above said axis A of the barrel 4.

In this way, the longitudinal extent of the release and percussion mechanism can be decreased, thereby the pivot point of the cock 78 can be brought closer to the striker 53.

Figure 11:
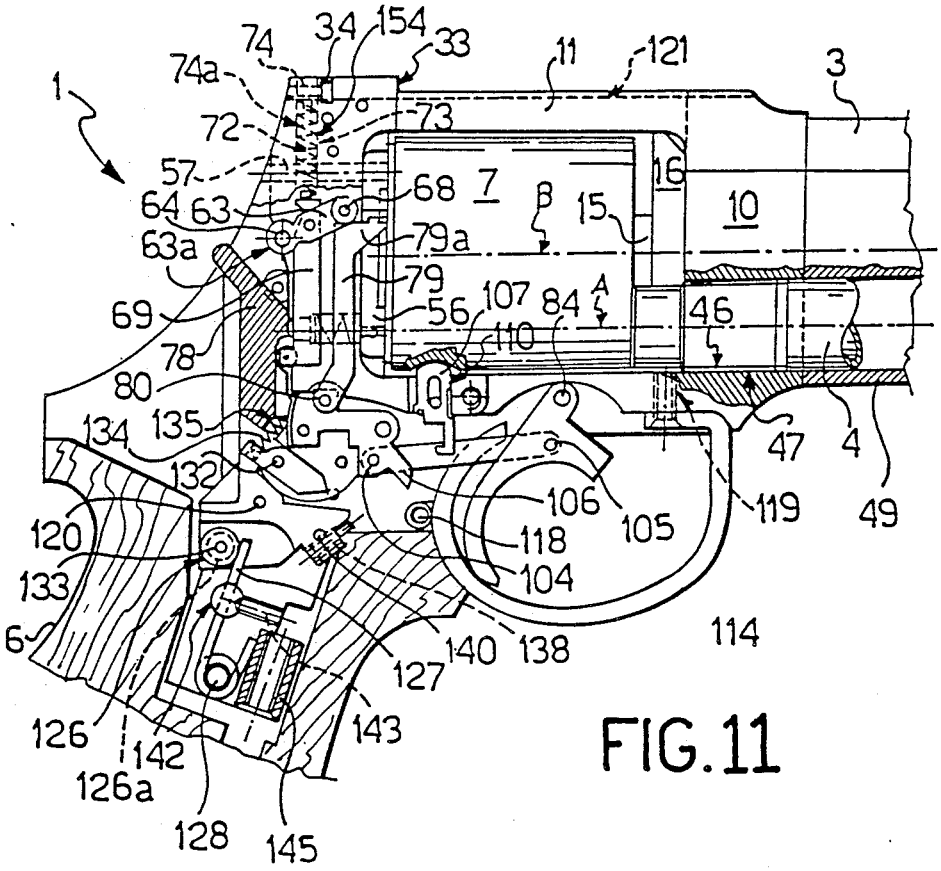
Figure 12:
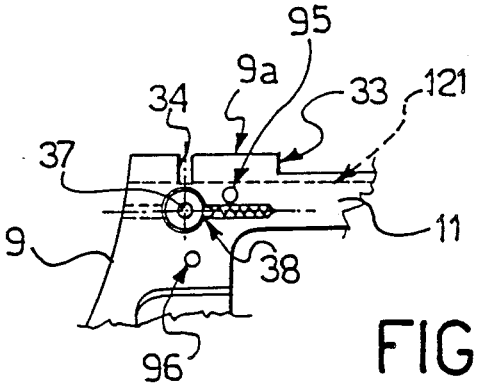
FIG. 12 is a side view of some details of the stock of the revolver shown in FIG. 1, taken in the direction of the arrow XII in FIG. 13.
Figure 13:
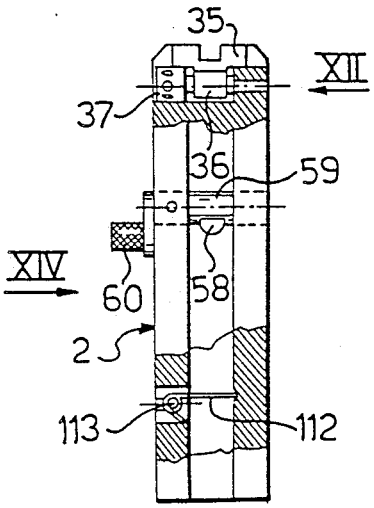
FIG. 13 is a side view of the stock of the revolver of FIG. 1 taken in the direction of the arrow XIII in FIG. 14.
Figure 14:
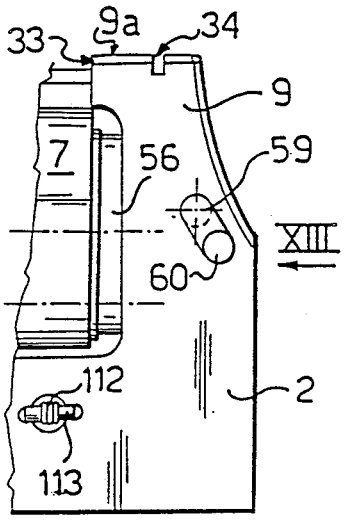
FIG. 14 shows schematically a side view of some details of the stock of the revolver of FIG. 1, taken in the direction of the arrow XIV in FIG. 13.

The mutual impact of these two parts can then take place on a plane exactly perpendicular to the axis A of the striker 53 with no undesired tangent components (see FIG. 11).

The distributor 81, which is journalled on the stock 2 by means of a respective pivot pin 97, comprises a center body 81*a*, substantially L-shaped, and a pair of U-shaped lugs 81*b* and 81*c* extending integrally from a short leg 99*a* and a long leg 99*b* of said "L", respectively (see FIGS. 26, 27 and 28).

The U-shaped lug 81*b*, extending from the short leg 99*a* integrally therewith, is provided with a pair of expansions 98*a,b* respectively through-penetrated by a pair of coaxial holes 100*a,b* designed to receive a cylindrical peg 101 extending therebetween and being adapted to cooperate with the cock 78, as best described herein below.

The central body 81*a* is further formed, at the ends of said "L", with a hole 102 for receiving the pin 97 and a hole 148 for receiving a pin 80 supporting the arm 79, respectively.

The U-shaped lug on the lever 81 comprises a first arm 103 and a second arm 103*a* lying parallel to the first but made shorter.

Between said arms 103 and 103*a* of the lug 81*c*, at a location proximate to the center body 81*a*, there is secured through holes 147*a*, 147*b* a pivot pin 104 on which a rod 82 is journalled which is also journalled, by means of a pin 105 at the opposite end, on the trigger 83 (see FIG. 1). The distributor 81 and rod 82 together constitute, as best described herein below, a kinematic train interconnecting the trigger 83, cock 78, and arm 79 and being, in turn, connected mechanically, via the lever plate 63, to the safety catch 69 which is constantly biased by a respective spring 72.

Thus, in accordance with a peculiar feature of this invention, both the safety catch 69 and the arm 79 are made movable vertically within the chamber 116 against the bias force of a spring means 154 including the spring 72 itself and being carried on the rear mount 9.

The arm 79 for rotating the cylinder 7 is substantially Z-shaped and journalled, at the bottom end 79*b* thereof, around the pivot pin 80 supported at 148 on the distributor 81 and fitting through a hole 79c in the arm 79.

A small wheel 70, carried on the lever 63, is constantly arranged to push, as best described herein below, on the top end 79a, triangular in shape, of the arm 79.

The lever plate 63, substantially rectangular in shape, has an eye-shaped end 63a mounted pivotally (see FIG. 6) around a smooth collar section 64b of a screw 64 which is threaded into a threaded blind hole 32 formed axially in the shaft 59 away from the cranked end 60. The lever 63 is therefore supported for idle pivotal movement relatively to the shaft 59 inside the chamber 116.

The lever 63 is formed, at an offset location from the eyed end 63a and along its longitudinal axis, with two holes 65, 66 (see FIGS. 6, 22 and 23) for receiving a pair of pins 67, 68 which extend from the lever 63 parallel to the shaft 59 and support the safety catch 69 and wheel 70, respectively.

Figure 6:
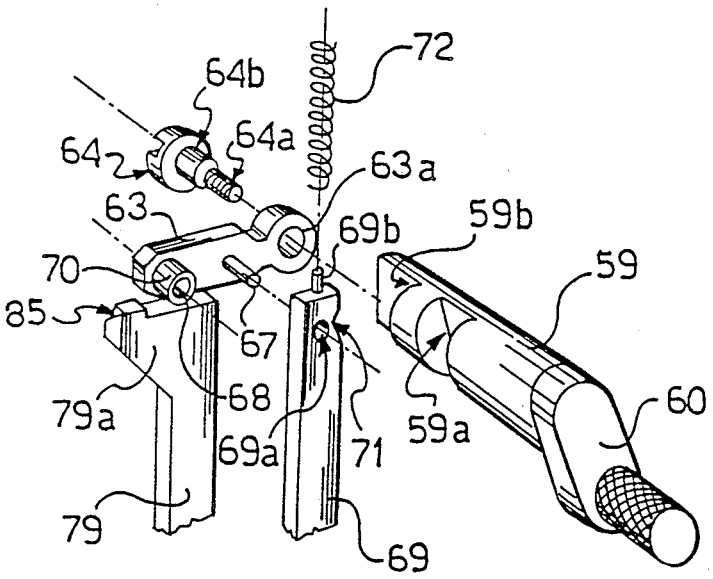
FIG. 6 is an exploded perspective view of some details of the revolver of FIG. 1, shown to an enlarged scale.

With reference to FIG. 6, it should be noted that the shaft 59 includes, proceeding from the cranked end 60, the aforesaid first camming profile 59a and, alongside it, a second camming profile 59b having a different inclination angle from the first.

With the gun in the firing trim and the cylinder 7 within the stock 2, the first camming profile 59a will bear on the pusher 58 for releasing the cylinder 7 (see FIG. 4), whilst the second camming profile 59b lies vertically (see FIG. 6) parallel to the rear edge of the safety catch 69 in substantial alignment to a recess 71. The recess 71 is adapted to provide, as more clearly explained herein below, a seat for receiving the second camming profile 59b during the operations to release the cylinder 7 from said firing position.

Figure 32:
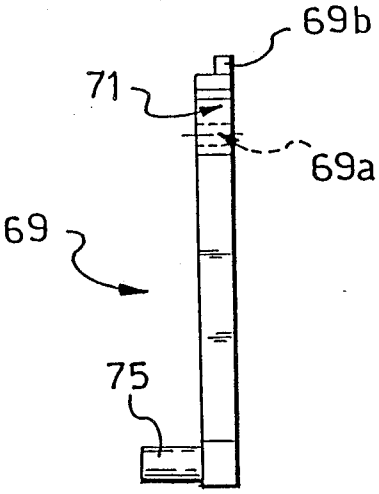
Figure 31:
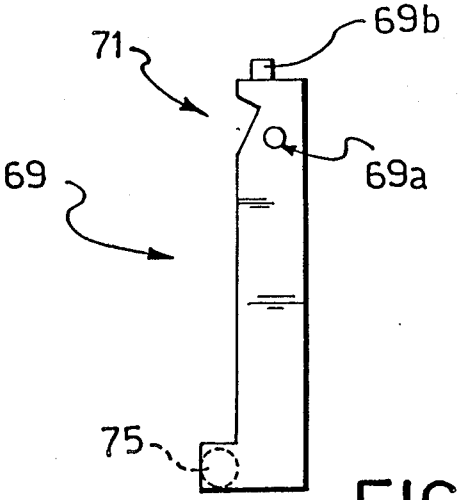

The safety catch 69 (see FIGS. 31 and 32) is substantially L-shaped and provided at the top with a hole 69a intended to receive the pin 67 and a lug 69b extending integrally therefrom. The lug forms a guide for the bottom end of the spring 72, positioned in a hole 73 extending vertically in the rear mount 9.

In accordance with a peculiar feature of this invention, the spring means 154 including the safety spring 72 also bias the arm 79 via the lever 63 and wheel 70. The arm 79, in particular, is not only biased vertically downwards but also in an oblique direction toward the cylinder 7. Owing to the peculiar Z-shape of the arm, in fact, the pivotal connection of the arm 79 to the distributor 81 and the pressure contact: wheel 70 - top end 79a, occur on parallel planes, which results in a clockwise-directed (as viewed in FIG. 1) torque being developed which is effective to constantly bias the arm 79 against the cylinder 7.

In order to drive the cylinder rotatively, said top end 79a of the arm 79 is terminated with a sloping bevel 85 adapted to selectively engage with one from a plurality of teeth 86 on an annular face rack provided on the ejector spider 18 on which, as previously mentioned, the top end 79a is constantly held pressed.

The teeth 86, which are provided in a number equal to the number of the cartridge chambers in the cylinder 7, have an outline profile matching that of the bevel 85.

Figure 7:
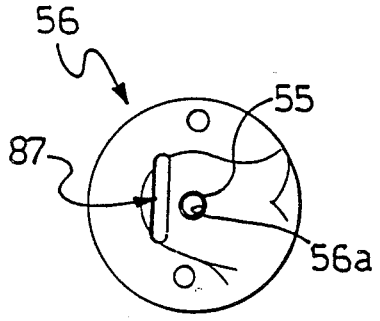
FIG. 7 is an elevation view of a detail of the revolver of FIG. 1.

To enable the top end 79a to engage with the teeth 86 and, accordingly, the cylinder 7 to be rotated, a slot 87 extends vertically across the shield 56, on the right-hand side of its central bore 55 (see FIG. 7).

A hole 88 for receiving a respective peg 89 is formed in the top end 79a at a location proximate to the oblique side thereof. The peg 89 prevents, by cooperating with a rear face of the shield 56, the arm 79 from jumping out of the slot 87 with the cylinder moved away from the stock.

The hole 73 accommodating the safety spring 72 (FIG. 11) is closed at the top, where a threaded portion thereof locates, by a cylindrical plug 74 from which a guide tang 74a extends downwards to guide the top end of the spring 72.

An integral cylindrical lug 75 (see FIG. 32) extends laterally from the safety catch 69, at a bottom end of the latter.

The cylindrical lug 75 engages slidably in a slideway 76 provided on the bottom of a recess 77 formed in the upper profile of the front side of the cock 78.

The slideway 76 (see FIG. 17) comprises a substantially elliptical upper section 76a adapted to receive the cylindrical lug 75 upon striking, and a lower section 76b (extending down toward the base of the cock 78) which defines a seat for accommodating that lug with the gun in its inoperative state. The slideway 76 practically forms a camming profile, and the cylindrical lug 75 forms a follower of said profile.

It should be noted that the sliding movement of the lug 75 across the recess 77 as far as the section 76b of the slideway 76 brings about a rearward movement of the cock 78 relatively to the striker 53 (gun with the safety applied), as more clearly explained herein below.

In accordance with a peculiar feature of this invention, the device 153 for setting the two-stage release comprises said wheel 70 and a small plunger 90 movable against the bias of a spring means 155 supported on the rear mount 9.

The plunger 90 fits slidably in a bush 91 threaded into a threaded hole 92 which provides a seat 156 therefor formed in the rear mount 9 at a location overlying the chamber 116 and open thereinto (see FIG. 9). Said spring means 155 comprises a spring 93, partway received in a blind hole 94a, formed in a threaded plug 94 and partway in the seat 156, which constantly biases the plunger 90 to an upper edge 91a of the bush 91.

In accordance with a peculiar feature of this invention, the plunger 90 is arranged to act on the arm 79 at an end portion of its travel across the chamber 116 as brought about on pressing the trigger 83 (see FIG. 11).

Two holes are indicated at 95, 96 (see FIG. 1) which interfere with the threadings of the threaded plug 94 and the bush 91, respectively, and are intended to accommodate respective rotation-preventing frictional elements, not shown.

To allow the cylinder unrestricted rotation by means of the arm 79, the distributor 81 is provided, at one end of the arm 103 (see FIG. 1), with a nib 106, extending integrally therefrom, which is adapted to interact with a cylinder 7 retaining means. The latter comprises an engagement member 107 having a plate-like center portion 107a and a hooked lug 107b projecting downwards integrally therewith (see FIGS. 29 and 30).

With the cylinder at the firing position, and prior to pressing the trigger 83 (gun in the inoperative condition), the nib 106 of the distributor 81 will be resting on the hooked lug 107b into a substantially horizontal position (see FIG. 1).

Formed in the center body 107a of the engagement member 107 is a slot 108 in which a pin 109 attached to the stock 2 at the lower crosspiece 12 is freely slidable.

The engagement member 107, which is movable vertically through a slot 110 provided in the lower crosspiece 12, is effective to retain the cylinder 7 by cooperating with corresponding notches 111 formed in the cylinder periphery, toward which notches it is constantly biased by a wire spring 112.

For that purpose, (see FIG. 1) the wire spring 112, which is wound around a pin 113 affixed to the left-hand side of the lower crosspiece 12, engages in a semicircular notch 107*c* formed in the center body 107*a*, downwardly and laterally of the slot 108. Accordingly, the spring 112 will constantly urge, offcentrally from the pin 109, the engagement member 107 in a vertical direction toward said notches 111.

On the stock 2, a guard 114, attached to it by means of a pin 118 and a screw, not shown, engaged in a hole 119, defines a front area where the trigger 83 locates. That area is communicated, through a passageway 115, with the chamber 116, formed in the rear mount 9 of the stock 2 and adapted to house the release and percussion mechanism 152 just described. The chamber 116 is closed on the right-hand side by a cheek piece 117 fastened to the stock 2 by conventional screws 151.

Figure 16:
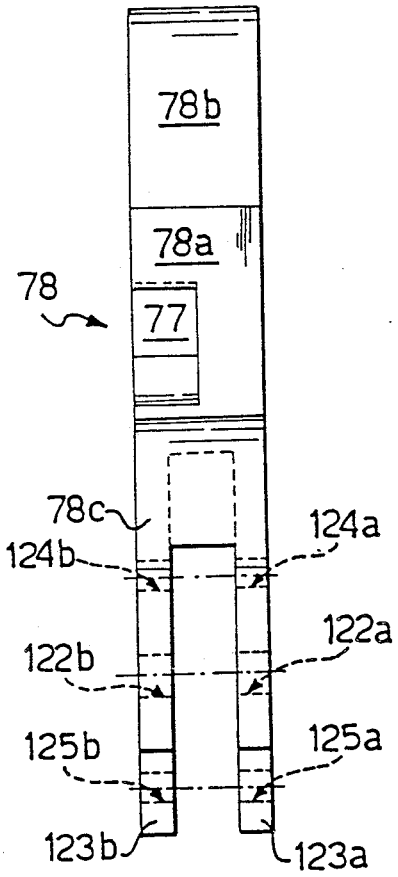
Figure 17:
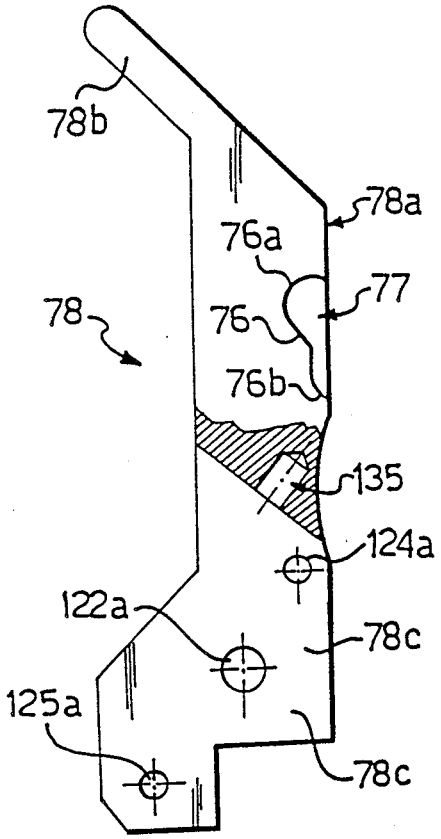

Inside the chamber 116 (see FIG. 1) there are secured said pin 84 for the trigger 83, the engagement member 107, the pin 97 of the distributor 81, and an additional pin 120. The cock 78 is pivoted around the latter of which shown clearly in FIGS. 16 and 17 are a portion 78*a* acting on the striker 53, the slideway 76, a ridge 78*b*, and a yoke-like base portion 78*c*. Said base portion 78*c* comprises two parallel arms 123*a,b* having the same length and being through-penetrated by a pair of holes 122*a,b* for mounting the cock 78 to the pin 120.

In accordance with a peculiar feature of this invention, the mainly vertical layout provided for the component parts of the release and percussion mechanism 152 brings about a substantial reduction in the distance separating the pin 120 for the cock 78 from the striker 53 over revolvers according to the prior art.

Thus, their mutual impact takes place in a perpendicular plane to the axis A and is unaccompanied by subtractive tangential components, to provide for nearly total utilization of the elastic potential energy stored up in a spring 127.

The arms 123*a,b* of the cock 78 are also provided, on opposite sides of the central holes 122*a,b*, with two more pairs of holes, an upper one 124*a,b* and lower one 125*a,b*.

A small wheel 126 (FIG. 8) is mounted on the cock 78 by means of a pivot pin 133 passed through said holes 125*a,b*. That wheel, which is grooved peripherally as at 126*a*, is intended to cooperate with the spring 127, wound around a respective pin 128, in turn affixed to a cylindrical lug 129 extending from the stock 2 (see FIG. 15). The spring 127 acts on the groove 126*a* of the wheel 126 to counteract an angular displacement of the cock 78 to the cocked position (in a counterclockwise direction as viewed in FIG. 1).

A nib 130 and a pawl 131 (see FIG. 11) are mounted on the cock 78 between the arms 123*a* and 123*b* of the base portion 78*c* respectively by means of a pin 132, fitted in the holes 124*a,b*, and of the aforesaid pins 120, 133, which fit in their corresponding holes 122*a,b* and 125*a,b*.

Advantageously, the pin 133 for the pawl 131 also provides, as previously mentioned, a mounting pin for the wheel 126 on the cock, and the pin 120 blocks the pawl 131 and cock 78 against relative rotation.

A spring 134 (FIG. 11), fitting partway in a seat 130*a* on the nib 130 and partway in a seat 135 on the base portion 78*c* of the cock 78, constantly urges the nib 130 to perform angular movements in a counterclockwise direction, as viewed in FIG. 1, about the axis of the pin 132.

Such movements are limited by a section 130*b* of the nib 130 abutting a section 131*a* of the pawl 131.

The nib 130 (FIG. 24) has on the front a bevel formation 130*c* and a back 130*d*, both adapted to cooperate with the cylindrical peg 101 on the distributor 81, as best explained herein below.

Figure 18:
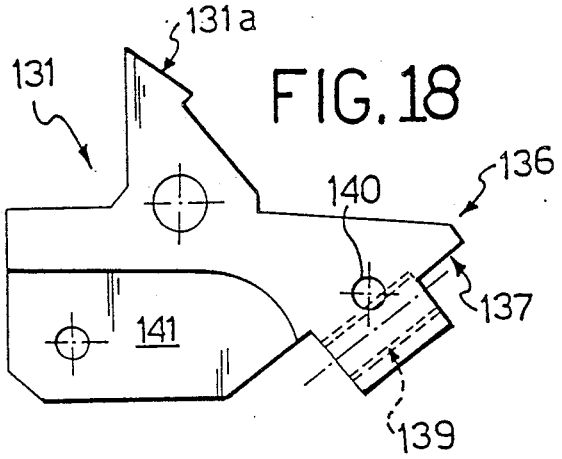
Figure 19:
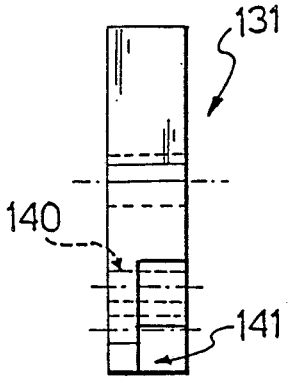
Figure 20:
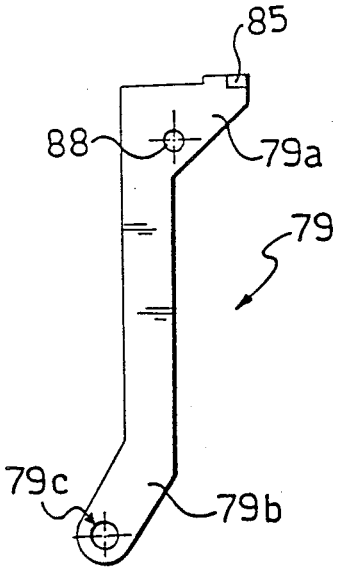
Figure 21:
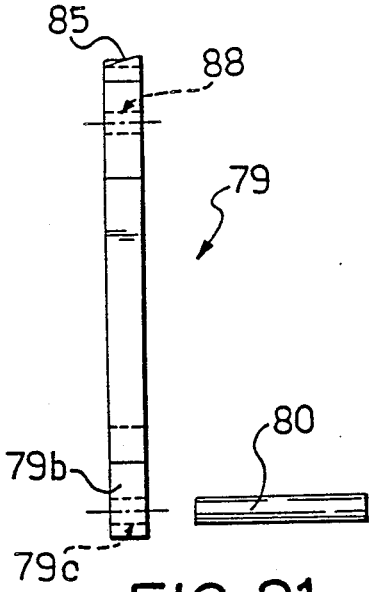

The cock 78 has on the front a working lug 136 (FIGS. 11, 18) adapted to cooperate, through a straight portion 137, in abutment relationship with the short leg 99*a* of the center body 81*a* of the distributor 81 (FIG. 9). In accordance with a peculiar feature of this invention, the working lug 136 on the cock is an integral part of the pawl 131 intervening between the arms 123*a* and 123*b* and secured therein by means of the above-noted pins 120,133. The extent of the engagement surface between the straight portion 137 and said short leg 99*a* may be adjusted by means of a screw 138 threaded into a corresponding threaded hole 139 provided in the pawl 131 (FIG. 18).

Indicated at 140 is a hole extending perpendicularly to the above hole 139 and interfering with the threading thereof, it being intended to receive a rotation-preventing frictional element which is quite conventional and not illustrated.

With reference to FIG. 11, it should be noted that the wheel 126 locates between the arm 123*b* of the cock 78 and the pawl 131, in a groove 141 of the latter.

The numeral 142 (see FIG. 15) designates a cylindrical pin which is attached to the cylindrical lug 129 by a screw 143 effective to provide, as explained herein below, a positive stop for the cock spring 127 by means of a cutout 144.

The cylindrical lug 129 has a yoke-like body between the legs whereof there extend the spring 127, pin 128, and pin 142.

The cylindrical lug 129 is further formed at the top with a pair of sloping bevels 129*a,b*, and at the bottom, with a threaded hole 145 to be engaged by a screw 146 for assembling the grip 6 to the stock 2.

OPERATION

Figure 8:
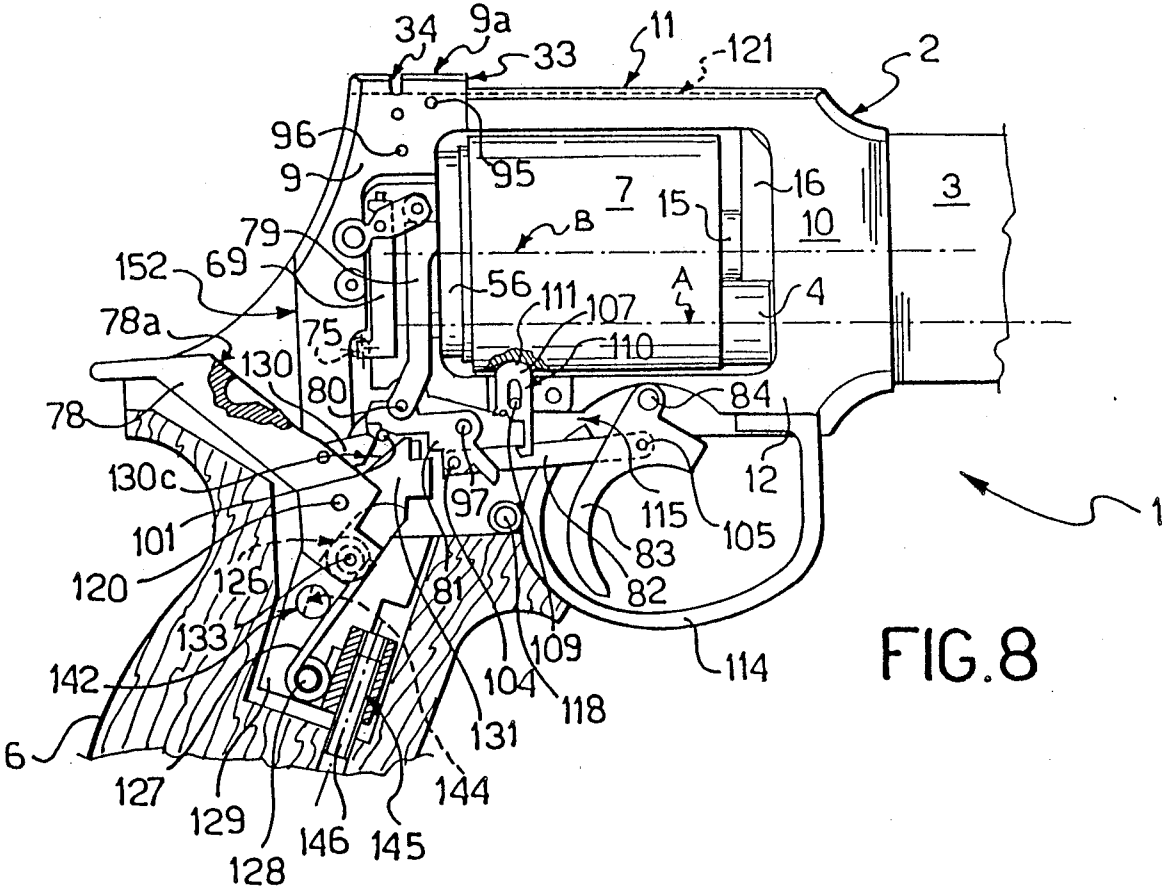

The operation of the revolver according to the invention will be now discussed with reference to FIGS. 8, 9 and 11.

In the double-action mode of operation, on pressing the trigger 83, the distributor 81 is caused to rotate around its pivot pin 97, thereby the bevel 130*c* on the nib 130 is made to contact the peg 101 carried on the distributor.

As the rearward movement of the trigger 83 is continued, the peg 101 will push on the nib 130 which, being prevented from pivoting relatively to the cock by its portion 130*b* contacting the portion 131*a* of the pawl 131, causes the cock to pivot around its pin 120 into the cocked position against the bias of the spring 127. In accordance with a peculiar feature of this invention, the spring 127 will nest in the groove 126*a* on the wheel 126 in the cocked condition.

The nib 130 is disengaged from the distributor 81 by the tilting movement of the cock combining with the pivotal movement of the distributor. On the peg 101 moving past the top section of the bevel 130*c*, as shown in FIG. 8, the cock 78 becomes disengaged from the distributor 81 and striking occurs by the action of the spring 127.

It follows that, in the double-action mode of operation of the revolver 1, the nib 130 will function as the cock 78 release tooth.

Figure 15:
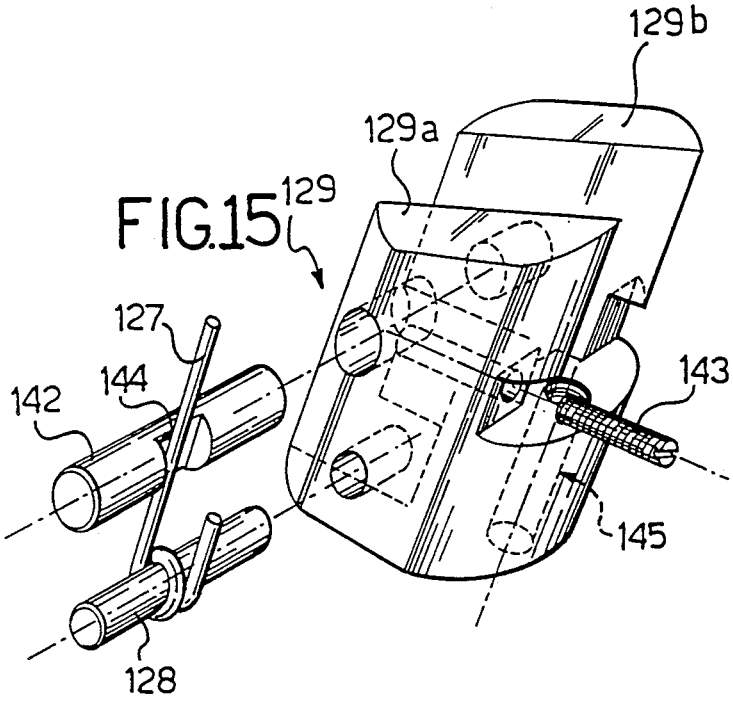
FIG. 15 is an enlarged scale, exploded perspective view of some details of the revolver shown in FIG. 1.

It should be noted that, in accordance with a peculiar feature of this invention, a stop is provided for the spring 127 in the path of the latter, which comprises the pin 142 in the example shown; thus, the spring 127 will be acting on the cock 78 for a major portion of its forward stroke, but for an end portion where said spring 127 is engaged by said stop. In particular, in the example shown, the spring 127 will move into the cutout 144 on the pin 142, as shown in FIG. 15. It follows that the cock 78 will not complete the end portion of its stroke under the direct effect of its spring 127 force but rather of its own inertial force propelling it toward the striker 53.

Concurrently with the movements just described, the arm 79 is raised by the distributor 81, thus causing the cylinder 7 to rotate by virtue of the drive force of the bevel 85 at the top end 79*a* onto the teeth 86 of the ejector spider 18, thereby another cartridge chamber is brought into alignment with the revolver barrel 4.

This rotation is allowed by the engagement member 107 being simultaneously lowered by the nib 106 of the distributor 81, which acts on the hooked lug 107*b* against the bias force of the wire spring 112.

This downward movement is guided by the sliding engagement of the pin 109 in the slot 108.

It should be noted that, soon as the nib 106 moves past said hooked portion 107*b*, the engagement member 107 is returned, by the action of the spring 112, to its position of interference with the next notch 111 on the cylinder 7 (see FIG. 11).

In accordance with a peculiar feature of this invention, the upward movement of the arm 79 causes, with the intermediary of the lever 63 journalled for idle pivotal movement on the shaft 59, the safety catch 69 to be simultaneously raised against the bias force of the spring means 154 comprising the spring 72.

The lever 63, which drivingly connects the arm 79 to the safety catch 69, is a lever of the second order affording a threefold advantage:

(i) decreased compression stroke of the spring 72 and, hence, of the spring length;

(ii) biasing of the arm 79 toward the cylinder 7 into a constant pressure contact relationship, thanks to the action of the spring 72; and (iii) accomplishment, by virtue of the reduced pivotal arm of the safety catch 69, of a beneficial reduction in the vertical movement of the safety catch consistently with the limited space available.

The safety catch 69, in fact, comes on striking to a position whereat its cylindrical lug 75 will fit into the recess 77 formed in the cock 78 so as not to interfere with the working portion (78*a*) of the cock during the striking step (see FIG. 11).

It should be noted, moreover, that the wheel 70, at all times bearing on the top end 79*a* of the arm 79, will drive the plunger 90 against the bias force of the spring means 155 and during an end portion of the arm movement across the chamber 116, which takes place during the final portion of the rearward travel of the trigger 83.

Thus, the pressure on the trigger 83 required to bring it fully to the rear can be controlled along with the striking action (two-stage release control).

The release control is advantageously achieved as regards the so-called "operation time" and "operation sharpness" by varying the position taken by the bush 91 and the threaded plug 94, respectively, by either screwing them in or out.

After the striking step, the release and percussion mechanism 152 of the revolver 1 will generally be at the position shown in FIG. 11.

In accordance with a peculiar feature of the invention, any unintentional releasing of the cylinder 7 would be prevented, with the trigger pressed and in all cases in the cocked condition, by the safety catch 69, and this by virtue of the positive stop provided by the second camming profile 59*b* on the shaft 59 in cooperation with the rear edge of the safety catch 69. At the position taken by the latter under such conditions, in fact, its recess 71 and the camming profile 59*b* are no longer aligned to each other.

On relieving the trigger 83 of the push exerted thereon, restoration of the whole release and percussion mechanism 152 and trigger 83 to their former conditions will only be brought about by the action of the spring 72 as drivingly connected to the distributor 81 via the lever 63 and arm 79.

Thus, the spring 72 advantageously serves a threefold function:

(i) safety catch spring;

(ii) return spring for the release and percussion mechanism; and (iii) spring for the arm 79;

thereby it affords best utilization of the elastic potential energy stored therein as a result of the trigger 83 operation.

During the aforesaid restoration of the release and percussion mechanism 152 to its initial (home) position, as shown in FIG. 1, the following will take place:

the safety catch 69 is moved down under the urge of its spring 72, as mentioned;

the peg 101 of the distributor 81 is caused to ride the back 130*d* of the nib 130 (release tooth) to re-position itself beneath the bevel 130*c* (the nib 130 is held in the correct position by the spring 134 resisting any pivotal movements thereof in the clockwise direction as caused by the sliding movement of the peg 101);

the cylindrical lug 75 of the safety catch 69 is caused to slide along the slideway 76 in the cock recess 77 towards the bottom section 76*b* of the slideway, thereby the cock 78 will move away from the striker 53 (automatic safety system);

the arm 79 is moved down, thereby the bevel 85 on its top end 79*a* will be re-positioned beneath the next tooth 86 on the contrate rack of the ejector spider 18; and the nib 106 of the distributor 81 is re-positioned above the corresponding hooked lug 107*b* of the engagement member 107.

In accordance with a peculiar feature of the invention, all of the above-noted movements take place without the return spring 72 being called upon to overcome the bias of the spring 127, by virtue of the cock 78 becoming disengaged therefrom during the last portion of the cock forward stroke, consequently to the stopping effect of the pin 142. Thus, the size of the spring 72 which favors return of the trigger to its home position (FIG. 1) can be advantageously reduced.

It should be noted that on the cock being driven rearwards by the movement of the cylindrical lug 75 of the safety catch 69 into the recess 77, the spring 127 will be re-positioned into the groove 126*a* on the wheel 126 in concurrent contact with the latter and the cutout 144 on the pin 142 (see FIG. 1).

Re-positioning of the nib 106 takes place after the engagement member 107 has been driven pivotally in a counterclockwise direction (as viewed in FIG. 1) around the pin 109 against the bias force of the spring 112. The latter will bring the member 107 back to position by driving it pivotally in a clockwise direction by virtue of its line of action being offset from the axis of the pin 109 (pivot axis of the member 107).

The single-action (manual cocking) mode of operation of the revolver of this invention will be now described with reference to FIGS. 9 and 11.

Cocking is accomplished in this case by tilting the cock 78 from the outside in a counterclockwise direction (as viewed in FIG. 9) against the bias of the spring 127.

This pivotal movement brings about a corresponding rearward movement of the trigger 83 within the guard 114 as caused by the pull exerted by the pawl 131 on the peg 101 of the distributor 81. The latter is, as previously mentioned, drivingly connected to the trigger via the rod 82.

The cocked condition is achieved on the straight portion 137 of the pawl 131 engaging the short leg 99*a* of the distributor 81, which has moved to a substantially vertical position (see FIG. 9) as a result of the distributor pivotal movement.

The extent of this engagement can be adjusted by means of the screw 138 to make the trigger more or less "sensitive" to the shooter's action. Also in this case, and as previously explained, the position taken by the safety catch 69 is effective to prevent unintentional release of the cylinder in the cocked condition of the revolver (abutment of parts from the safety catch and the second camming profile 59*b* of the shaft 59).

Continued rearward movement of the trigger 83, now also resisted by the second stage spring 93, will cause—through the drive including the distributor 81, arm 79, wheel 70, and plunger 90—the pawl 131 to become disengaged from the short leg 99*a* of the distributor 81, thus allowing the cock 78 to strike under the urge of its spring 127.

The pawl 131 here forms, as against what takes place in the double-action mode, the release tooth for the cock 78.

In accordance with a peculiar feature of this invention, the specific construction of the distributor 81 (provision of the expansion pair 98*a,b*), in combination with the peg 101 enables single-action cocking while drastically limiting, over debased barrel revolvers according to the prior art, the difference in angular travel from the double-action operation, which difference is limited in this case to just 6°.

On account of the constructional and operational features described herein above, the revolver of this invention affords the following advantages:

near-full utilization of the elastic potential energy stored up in the release and percussion mechanism 152 which now has a mainly vertical layout of reduced bulk in the longitudinal direction;

improved gun trim in firing, thanks to the more compact design of the revolver;

simpler release and percussion mechanism than in debased barrel revolvers according to the prior art:

The disengagement of the cylinder 7 from the stock (firing position) to reload with fresh cartridges is accomplished, as shown in FIGS. 4 and 5, by pushing the crank 60 on the shaft 59 toward the cylinder. Accordingly, the pusher 58, as driven by the first camming profile 59*a*, will cause the pin 21 to move into the bore 20 against the bias of the spring 22 and permit the cylinder 7 disengagement.

It should be noted that during the shaft 59 rotation, the second camming profile 59*b*, lying parallel to the first, will fit into the recess 71 on the safety catch 69 facing it.

In accordance with a peculiar feature of this invention, unintentional cocking, either in the single- or double-action mode, with the cylinder not fully inserted in the stock, is positively prevented by the second camming profile 59*b* (housed in the recess 71) of the shaft 59 abutting the safety catch 69. This opposing action prevents, in fact, the safety catch 69 from being raised on cocking in the manner previously described.

Rotational movement of the shaft 59 to unlock the cylinder 7 is instead prevented, in the cocked condition and in all cases with the trigger pressed, by the second camming profile 59*b* abutting the rear edge of the safety catch 69, as described herein above. It should be further noted that the shaft 59 is locked releasably by the ball detent device 61 in the positions it has taken with the cylinder swung into and out of the stock.

To reload the gun, the cylinder 7 is swung above the upper crosspiece 11 by means of the tilting member 8.

Fired cartridges are ejected by driving the ejector spider 18 rearwards by means of the ejector rod 17, overcoming the bias force of the spring 28 which will then re-position it inside the tubular arm 15.

The line of sight of the revolver 1, finally, is adjusted in range and aim independently at the sight 5 and rear sight 35 by manipulating the above-described screws 42 and 37, respectively.

I claim:

1. A debased barrel revolver comprising a stock having rear mount, a cylinder carried rotatably on said stock at a location close against aid rear mount, a barrel mounted on said stock aligned to a bottom cartridge chamber of the cylinder, a release and percussion mechanism, and a chamber formed in the rear mount and extending therein in a perpendicular direction to and above said barrel, wherein said release and percussion mechanism comprises a trigger pivoted on said stock, a distributor lever pivoted on said stock and operatively linked to said trigger, a cylinder rotating arm movable vertically within said chamber and having a bottom end journalled of said distributor lever and a top end engaged with the cylinder, a rod-like safety catch lying parallel to said arm and being movable vertically within said chamber, first spring means carried on the rear mount and biasing said safety catch, a lever connecting said top end to said safety catch and a two-stage release mechanism setting device operatively linked to said top end.

2. A debased barrel revolver according to claim 1, characterized in that said two-stage release mechanism setting device comprises a small plunger movable against the bias of a second spring means in a seat provided in said rear mount to a position overlying and open to said chamber, said small plunger being arranged to act on said arm at an end portion of the movement thereof across said chamber.

3. A debased barrel revolver according to claim 2, characterized in that said second spring means comprises a spring partway received in a blind hole in a threaded plug operable from the outside of said rear mount to allow said spring to be set.

4. A debased barrel revolver according to claim 2, characterized in that said small plunger is mounted for sliding movement in a bush threadably fitting in said seat in an adjustable manner.

5. A debased barrel revolver according to claim 1, characterized in that said safety catch comprises a cylindrical lug in sliding engagement with a slideway formed on a cock.

6. A debased barrel revolver according to claim 5, characterized in that on said slideway there is defined a camming profile whereon said lug rides.

7. A debased barrel revolver according to claim 1, characterized in that said lever, said first spring means, and said two-stage release mechanism setting device are supported on said rear mount above said barrel.

8. A debased barrel revolver according to claim 1, characterized in that said lever has an eye-shaped end supported pivotally on a small cylindrical shaft extending transversely across said chamber and projecting outwards from said mount with a cranked end for its operation.

9. A debased barrel revolver according to claim 9, characterized in that said shaft includes a first camming profile adapted to act on a pusher extending in said rear mount perpendicularly to the shaft, operative to release said cylinder from said stock.

10. A debased barrel revolver according to claim 9, characterized in that said shaft includes a second camming profile operative to releasably engage said rod-like safety catch.

11. A debased barrel revolver according to claim 1, characterized in that said distributor comprises a substantially L-shaped center body, U-shaped first and second lugs integrally extending respectively from a short leg and a long leg of said "L", a cylindrical peg extending between first and second expansions of said first U-shaped lug.

12. A debased barrel revolver according to claim 1, characterized in that said distributor is linked operatively to said trigger by a rod.

13. A debased barrel revolver according to claim 11, characterized in that said peg and said short leg are adapted to respectively cooperate with a nib and a working lug of said cock to move the latter rearwards against the bias of a spring.

14. A debased barrel revolver according to claim 13, characterized in that said spring is carried on the stock to urge said cock toward a striker, a positive stop being provided for said spring at a predetermined section of the travel path of said cock toward the striker.

15. A debased barrel revolver according to claim 11, characterized in that said second U-shaped lug has a first arm provided at one end with a nib adapted to interact with a securing means for said cylinder.

16. A debased barrel revolver according to claim 15, characterized in that said cylinder securing means comprises an engagement member movable vertically through a slot provided in a lower crosspiece of the stock against the bias of a wire spring.

* * * * *